United States Patent [19]

Hamilton et al.

[11] 4,113,522

[45] Sep. 12, 1978

[54] METHOD OF MAKING A METALLIC STRUCTURE BY COMBINED SUPERPLASTIC FORMING AND FORGING

[75] Inventors: C. Howard Hamilton, Thousand Oaks; Leonard A. Ascani, Palos Verdes Estates, both of Calif.

[73] Assignee: Rockwell International Corporation, El Segundo, Calif.

[21] Appl. No.: 736,671

[22] Filed: Oct. 28, 1976

[51] Int. Cl.[2] ..... C22F 1/00
[52] U.S. Cl. ..... 148/11.5 R
[58] Field of Search ..... 148/11.5 R

[56] References Cited

U.S. PATENT DOCUMENTS

| | | | |
|---|---|---|---|
| 3,591,916 | 7/1971 | Arthur | 148/11.5 R |
| 3,997,369 | 12/1976 | Grimes et al. | 148/11.5 R |
| 3,998,665 | 12/1976 | Oshida | 148/11.5 R |

*Primary Examiner*—W. Stallard
*Attorney, Agent, or Firm*—Charles T. Silberberg

[57] ABSTRACT

A method for making metallic structures especially those having a complex variable thickness, utilizing superplastic forming and forging. A metal preform having superplastic characteristics is positioned relative to a shaping member which substantially defines the final configuration of the preform. The preform is superplastically expanded and forged against the shaping member to produce the final structure.

12 Claims, 4 Drawing Figures

METHOD OF MAKING A METALLIC STRUCTURE BY COMBINED SUPERPLASTIC FORMING AND FORGING

BACKGROUND OF THE INVENTION

The present invention relates to a process for fabricating metallic structures utilizing superplastic forming and forging. For many years it has been known that certain metals, such as titanium and many of its alloys, exhibit superplasticity. Superplasticity is the capability of a material to develop unusually high tensile elongations with reduced tendency towards necking. This capability is exhibited by only a few metals and alloys and within limited temperature and strain rate range. An example of the superplastic forming process is disclosed in U.S. Pat. No. 3,340,101, to Fields, Jr., et al.

However, superplastic forming by its very nature, (i.e. reduced tendency toward necking) produces a constant overall deformation such that the thickness of the final structure is substantially the same throughout. Accordingly, superplastic forming is not used to fabricate many variable thickness fittings and clips which typically are machined from bar, plate, or forging stock at high cost and with attendant substantial waste of material.

SUMMARY OF THE INVENTION

It is, therefore, an object of the present invention to efficiently fabricate complex variable thickness structures.

It is another object of the present invention to make metallic structures in a single operation by a combination of superplastic forming and forging.

It is still another object of the present invention to fabricate deep drawn variable thickness parts.

Briefly, in accordance with the invention, there is provided a method for making metallic structures which combines superplastic forming and forging. A metal preform having superplastic characteristics and a shaping member which substantially defines the final configuration of the preform are provided. The preform is brought to within a temperature range suitable for superplastic forming. Pressure is applied to the preform to cause at least a portion thereof to expand superplastically. At least a portion of the preform is forged against the shaping member.

In a preferred embodiment, two shaping members are provided and the preform is superplastically expanded and deformed against at least one of the shaping members and forged between the shaping members. Optimally, the temperature range suitable for superplastic forming of the preform is also suitable for forging of the preform.

Other objects and advantages of the invention will become apparent upon reading the following detailed description and upon reference to the drawings.

While the invention will be described in connection with the preferred embodiments, it will be understood that it is not intended to limit the invention to those embodiments. On the contrary, it is intended to cover all alternatives, modifications, and equivalents that may be included within the spirit and scope of the invention as defined by the appended claims.

DETAILED DESCRIPTION OF THE INVENTION

In order for superplastic forming to be successful, it is necessary to use a material that is suitable. The extent to which any material selected will exhibit superplastic properties is predictable in general terms from a determination of its strain rate sensitivity and a design determination of the permissible variation of wall thickness. Strain rate sensitivity can be defined as $m$ where $$m = \frac{d \ln \sigma}{d \ln \dot{\epsilon}}$$

and $\sigma$ is stress in pounds per square inch and $\dot{\epsilon}$ is strain rate in reciprocal minutes. Strain rate sensitivity may be determined by a simple and now well recognized torsion test described in the article "Determination of Strain-Hardening Characteristics by Torsion Testing," by D. S. Fields, Jr., and W. A. Backofen, published in the proceedings of the ASTM, 1957, Volume 57, pages 1259–1272. A strain rate sensitivity of about 0.5 or greater can be expected to produce satisfactory results with the larger the value (to a maximum of 1) the greater the superplastic properties. Maximum strain rate sensitivity in metals is seen to occur, if at all, as metals are deformed near the phase transformation temperature. Accordingly, the temperature immediately below the phase transformation temperature can be expected to produce the greatest strain rate sensitivity. For titanium and its alloys the temperature range within which superplasticity can be observed is about 1450° F. to about 1850° F. depending upon the specific alloy used.

Other variables have been found to affect strain rate sensitivity and therefore should be considered in selecting a suitable metal material. Decreasing grain size results in correspondingly higher values for strain rate sensitivity. It has been found that the $m$-value reaches a peak at an intermediate value of strain rate (approximately $10^{-4}$ in./in./sec.). For maximum stable deformation, superplastic forming should be done at this strain rate. Too great a variance from the optimum strain rate may result in a loss of superplastic properties.

Figure 1:
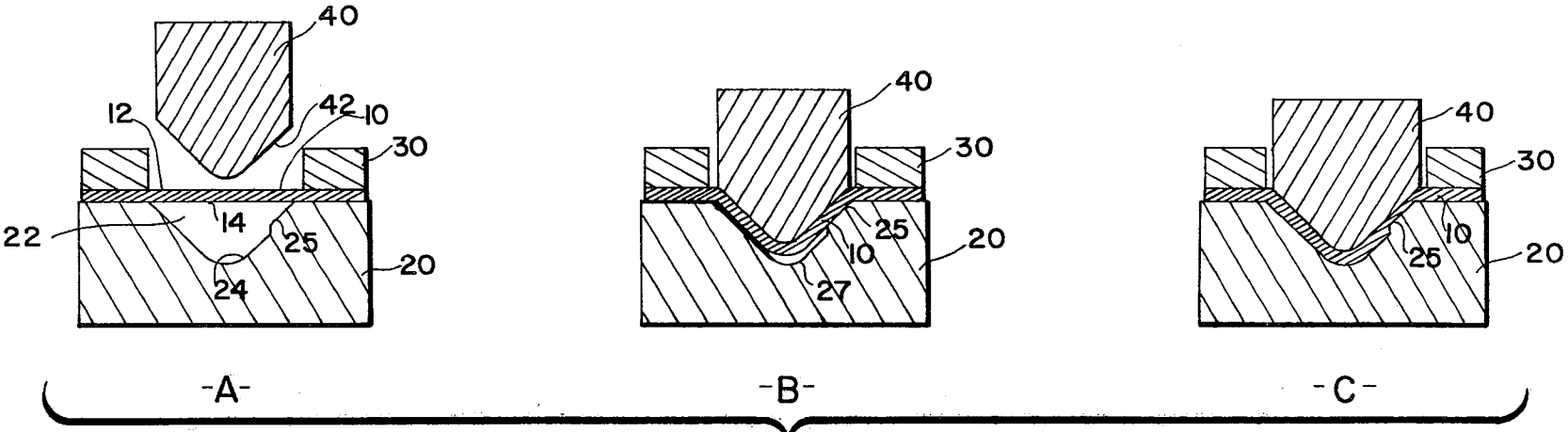
FIG. 1 is a cross-sectional diagramatic illustration of a first embodiment of the present invention illustrating the initial position of the preform relative to the shaping members at A, an intermediate position upon completion of superplastic forming at B, and the final formed structure after forging at C.

Turning first to FIG. 1, there is shown a first embodiment of the present invention. Preform 10 is preferably a metal blank in the form of a sheet having upper and lower opposed principal surfaces 12 and 14. Any metal that exhibits suitable superplastic properties can be used, but the present invention is particularly concerned with titanium or an alloy thereof, such as Ti-6A1-4V. Additionally, it is preferable that the metal used for preform 10 be capable of plastic deformation under compressive pressure at obtainable economical temperatures (titanium and the aforementioned alloy meet this qualification). The initial thickness of preform 10 is determined by the dimensions of the part to be formed.

Preform 10 is supported on shaping member 20. Shaping member 20 defines a chamber 22 and female die surface 24. Die surface 24 has a projecting portion 25 thereon. A hold-down ring 30 acts as a clamping means for the preform 10. A single continuous edge of preform 10 is effectively constrained between hold-down ring 30 and shaping member 20. A punch or shaping member 40 has a male die surface 42 which preferably is in mating relationship with die surface 24.

The dimensions of shaping members 20 and 40 are such that they are complementary to the shape desired to be formed, i.e., the unconstrained portion of preform 10 would conform to die surface 24 on surface 14 and to die surface 42 of punch 40 on surface 12. A primary consideration in selection of a suitable shaping member alloy is reactivity with the metal to be formed at forming temperatures. When the metal to be formed is titanium or an alloy thereof, iron base alloys with low nickel content and modest carbon content (as 0.2–0.5% carbon) have been successful. Since forming loads are relatively low, creep strength and mechanical properties are fairly unimportant.

FIG. 1B illustrates the superplastic forming of preform 10. While in this embodiment superplastic forming occurs before forging, the sequencing is not critical. Either operation could be conducted initially followed by the other, or in some cases both operations could be conducted concurrently.

For superplastic forming, preform 10 must be brought to within a temperature range at which it exhibits superplastic characteristics, if it is not already in that range. Various heating methods can be used for heating preform 10 to the desired temperature range (where the metal would be in a plastic state having a suitable strain rate sensitivity). Thus, the forming apparatus can be placed between heating platens (not shown) such as disclosed in U.S. Pat. No. 3,934,441 to Hamilton, et al. This method is advantageous as it also heats shaping members 20 and 40 so that the areas of preform 10 contacted by shaping members 20 and 40 during forming (and forging) do not have their temperatures substantially affected.

Forming of preform 10 into the basic configuration can be accomplished by pressure from punch 40 or by a pressure differential around preform 10. Such a pressure differential method is disclosed in U.S. Pat. No. 3,934,441 to Hamilton, et al. It has been found that differential pressures that can be used for superplastic forming normally vary from 15 to 300 psi. When a differential pressure is used, the preform acts as a diaphragm. As shown in FIG. 1B, this embodiment uses male die member 40 which is forced against preform 10 at a rate such as to cause superplastic forming. This rate should be such that the superplastic strain rate is not exceeded. Forming times depend upon diaphragm thickness, material superplastic properties, and the pressure (or rate of die 40 movement) used and may vary from 10 minutes to 16 hours. As can be seen in FIG. 1B, the unconstrained portion of preform 10 is superplastically formed against die surface 42 and preferably in sufficient amount to also deform against die surface 24. The superplastically formed preform 10 has a uniform thickness. However, a part of preform 10 does not contact the lower essentially recessed portion 27 of die surface 24 due to the uniform deformation of superplastic forming, i.e. the remaining portion of die surface 24 is in contact with preform 10 so that punch 40 cannot be moved further downward without a substantial increase of pressure which would exceed the strain rate necessary for superplastic forming.

The completion of the process is shown in FIG. 1C. The pressure applied by punch 40 (a differential pressure could also be used to forge preform 10 but would not be a desired approach because of the extremely large gas pressures required with consequent sealing problems and the fact that gas pressure would be uniform over the surface of preform 10) is increased and sustained allowing creep to occur as in conventional "hot die" or isothermal forging such that preform 10 is forged between shaping members 20 and 40 from the configuration of FIG. 1B to that of FIG. 1C (this forces flow of preform 10 against recessed portion 27). This forging is similar to that disclosed in U.S. Pat. No. 3,519,523 to Moore, et al. where the preform is in a condition of low strength and high ductility when forged. The forging is in hot dies at a forging temperature within about 350° F. of but not exceeding on a sustained basis the normal recrystallization temperature of the alloy, while inhibiting substantial grain growth. Optimally, the temperature range used for superplastic forming of preform 10 would also be suitable for forging of the preform 10. Typically, with Ti-6A1-4V, a temperature of about 1700° F. can be used for both the forging and superplastic forming steps. The forging pressure that can be used can vary and it depends upon many parameters such as the particular metal or alloy used for preform 10, how formable it is at the forming temperature, thickness of preform 10, amount of deformation required for preform 10, and desired time of processing, etc. Applicants have found that for titanium and its alloys, and particularly the Ti-6A1-4V alloy, the range of pressure than can be used is 1500–10,000 psi, with the preferred range being about 2000–6000 psi, with the lower end of the preferred range producing better results. Depending upon the configuration, this pressure is normally applied for 4–5 hours, but could be as low as one-half hour when simple shapes are to be fabricated.

While the part to be formed as shown in FIG. 1C could not be accomplished by forging alone due to the large stretching required (see FIG. 1B), a high degree of forging is possible. This is due to the typically low flow stresses of a superplastic material. Thus the forging loads can be sustained for a prolonged time period to capitalize on the available low flow stresses of the superplastic preform. The heated dies prevent undesirable cooling of the part to be forged. It should be noted that the flow stresses are lower at lower strain rates. This permits reduced pressures to cause the forging (albeit at lower strain rates) and the forging of relatively thin members.

As can be seen in FIG. 1C, the part formed has a variable thickness, having its greatest thickness along the continuous edge constrained between ring 30 and shaping member 20 (where such portion is not to be trimmed from the completed part), its thinnest section where it overlies protruding portion 25 of die surface 24, and a portion having an intermediate thickness which overlies the remaining portion of die surface 24 of shaping member 20.

When the preform 10 is a reactive metal such as titanium and its alloys, whose surface would be contaminated at the elevated temperatures required for superplastic forming, the present method would be accomplished in an inert atmosphere. A contamination prevention system which could be used to provide such an inert atmosphere is disclosed in U.S. Pat. No. 3,934,441 to Hamilton, et al.

After the forming operation, the part 10 is removed, trimmed, cleaned, and further processed as required for its intended application. Tooling can be heated and cooled for each part produced or it can be maintained at the process temperature range and each part produced, ejected, and removed and a subsequent sheet inserted and formed immediately thereafter.

Figure 2:
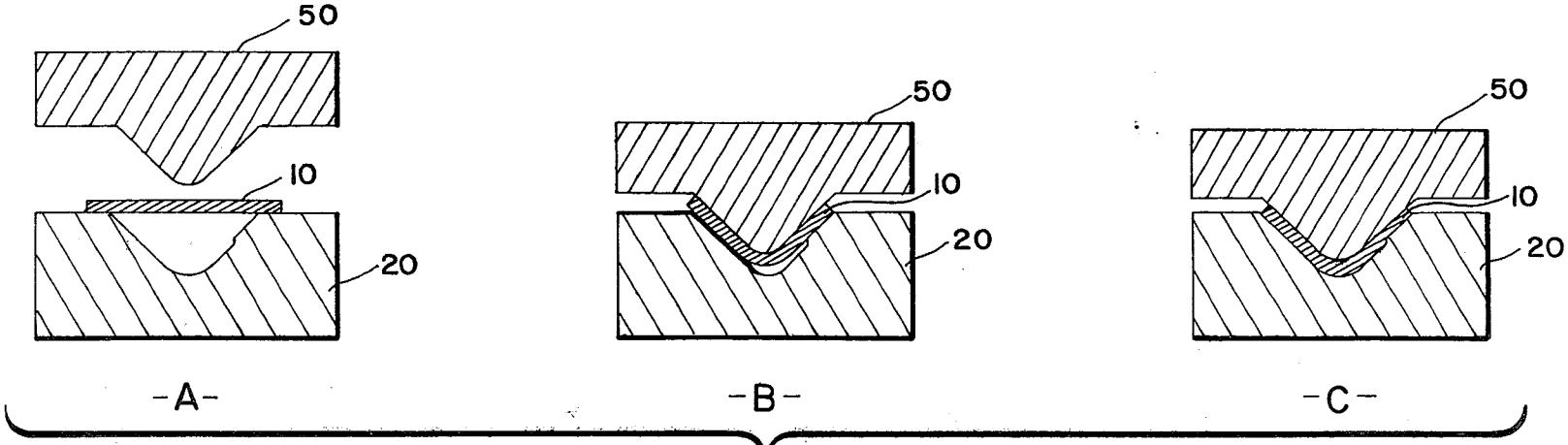
FIG. 2 is a cross-sectional diagrammatic illustration of a second embodiment of the present invention illustrating the initial position of the preform relative to the shaping members at A, an intermediate position upon completion of superplastic forming at B, and the final formed structure after completion of forging at C.
Figure 3:
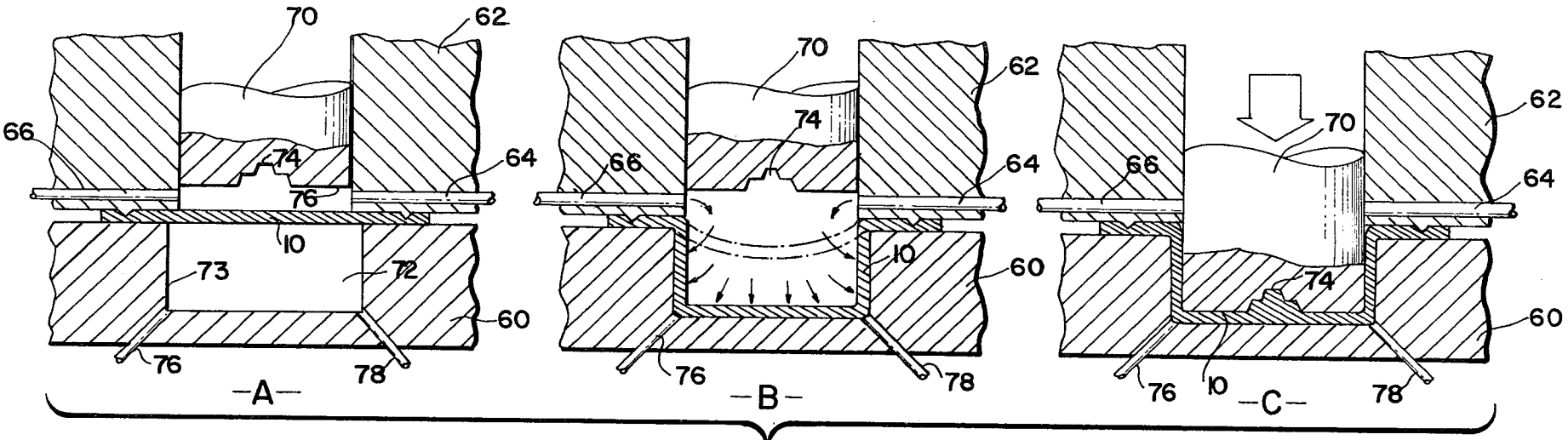
FIG. 3 is a cross-sectional diagramatic illustration of a third embodiment of the present invention illustrating the initial position of the preform relative to the shaping members at A, intermediate positions of the preform at B shown by the broken lines which illustrates a position of the preform during superplastic forming and the solid lines which illustrate the position of the preform after completion of superplastic forming, and the final formed structure after completion of forging at C.
Figure 4:
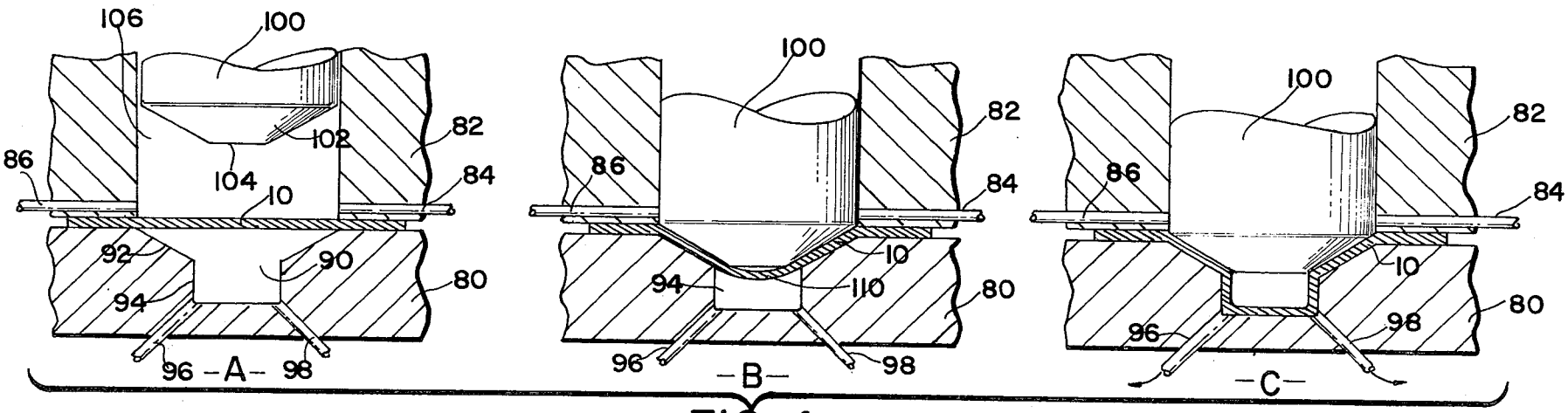
FIG. 4 is a cross-sectional diagramatic illustration of a fourth embodiment of the present invention illustrating the initial position of the preform relative to the shaping members at A, an intermediate position of the preform after completion of forging at B, and the final formed structure after completion of superplastic forming at C.

Additional embodiments of the present invention are illustrated in FIGS. 2, 3, and 4. The previous discussion of the requirements for superplastic forming and forging such as elevated temperatures, suitable preform material, and necessary pressure are also as should be understood applicable to these embodiments.

A second embodiment of the present invention is shown in FIG. 2. In this embodiment, the workpiece 10 is not clamped at its periphery such as by hold-down ring 30 in FIG. 1, but allowed to pull into the die cavity during the forming operation. FIG. 2A illustrates the initial position of preform 10 relative to shaping members 20 and 50. FIG. 1B illustrates the preform 10 after its superplastic forming is completed by male die member 50. The completely formed part 10 is shown in FIG. 2C where the forging has been accomplished by increased pressure applied by shaping member 50 for the necessary time duration.

FIG. 3 illustrates another embodiment of the present invention. In this embodiment, the initial position of preform 10 is shown in FIG. 3A. Preform 10 has a single continuous edge thereof constrained between shaping members 60 and a ring-like hold-down member 62. Gas lines 64 and 66 are provided in member 60. These can form part of the contamination prevention system as previously discussed. A piston-like punch 70 is provided above preform 10 in the annular area defined by the ring-like member 62. A cavity 72 is defined by shaping member 60. Punch 70 has a groove 74 on its contact surface 76.

FIG. 3B illustrates the superplastic forming of preform 10 from its initial position to an intermediate position shown by the broken lines of FIG. 3B and to the final position shown by the unbroken lines. Such superplastic forming is accomplished by gas pressure through lines 64 and 66 which are connected to a source (not shown) of inert gas. Such gas pressure would also preferably be in the range of about 15–300 psi. As preform 10 deforms, inert gas is vented from chamber 72 through vent lines 76 and 78 in shaping member 60.

The preform 10 is formed to its final shape by a forging step illustrated in FIG. 3C. As shown, punch 70 moves downward and applies a forging pressure along its contact surface 76 to preform 10. Such forging pressure acts to compress the contacted portions of preform 10 forcing material flow up into groove 74. The portion of preform 10 which flows into groove 74 is shaped to conform to groove 74 by virtue of the plastic state of preform 10 due to the elevated temperature. As the remaining portion of preform 10 which contacts surface 76 and does not flow into groove 74 is compressed, its thickness is less than the portion of preform 10 which contacts the side walls 73 of chamber 72. The portion of preform 10 which protrudes into groove 74 is of an increased thickness which can vary depending upon the shape of groove 74.

FIG. 4 illustrates another embodiment of the present invention. As shown in FIG. 4A, preform 10 in its initial position is constrained between a lower shaping member 80 and an upper ring-like retaining member 82. Gas lines 84 and 86 are provided in retaining member 82 to provide an inert atmosphere over preform 10. Shaping member 80 has a cavity 90 defined therein. Cavity 90 has an upper tapered portion 92 and a lower portion 94 of uniform width. Fluid lines 96 and 98 are provided at the bottom of portion 94 of cavity 90. These lines are connected to a source of vacuum (not shown). A piston-like punch or shaping member 100 having a contact surface made up of a tapered portion 102 which mates with tapered portion 92 of cavity 90 and a level portion 104 is located in the annular area 106 defined by retaining member 82.

As shown in FIG. 4B, punch 100 is moved downward and applies a compressive forging pressure to preform 10 where it contacts the walls of portion 92 of cavity 90. The remaining portion 110 of preform 10 extends into portion 94 of cavity 90.

Portion 110 of preform 10 is then superplastically formed as shown in FIG. 4C by application of vacuum (positive pressure could also be applied above portion 110 by application of gas through lines, not shown, which would run through punch 100) through lines 96 and 98 and deforms to conform to portion 94 of cavity 90. The portion of preform 10 which is contacted by the tapered sides 102 of punch 100 is retained by pressure from punch 100 and consequently does not have its thickness varied by superplastic forming, i.e. portion 110 has its thickness reduced by its expansion to conform to portion 94 of cavity 90.

Thus, it is apparent that there has been provided in accordance with the invention, a method of making metallic structures which combines superplastic forming and forging that fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

What is claimed is:

1. A method of making metallic structures comprising the steps of:

providing a metal preform having superplastic characteristics;

providing a shaping member substantially defining the desired final configuration of said preform;

bringing said preform to within a temperature range suitable for superplastic forming of said preform;

inducing tensile stress in said preform by applying pressure to said preform sufficient to cause at least a portion of said preform to expand superplastically; and forging by increasing said pressure at least a portion of said preform against said shaping member.

2. The method of claim 1 wherein at least a portion of said preform deforms against said shaping member when expanded superplastically.

3. The method of claim 2 wherein said forging is by application of a fluid pressure loading on said preform.

4. A method of making metallic structures comprising the steps of:

providing a metal preform having superplastic characteristics;

providing at least two shaping members, said shaping members substantially defining the desired final configuration of said preform;

bringing said preform to within a temperature range suitable for superplastic forming of said preform;

inducing tensile stress in said preform by applying pressure to said preform sufficient to cause at least a portion of said preform to expand superplastically; and forging at least a portion of said preform between said shaping members by application of pressure, greater than in said inducing step, to said preform.

5. The method of claim 4 wherein at least a portion of said preform deforms against at least one of said shaping members when expanded superplastically.

6. The method of claim 5 wherein said shaping members are brought to within said temperature range in the step of bringing said preform to within a temperature range suitable for superplastic forming.

7. The method of claim 5 wherein said temperature range suitable for superplastic forming is also suitable for the forging step.

8. The method of claim 5 also including the step of bringing said preform to within a temperature range suitable for forging.

9. The method of claim 5 also including the step of bringing said preform and said shaping members to within a temperature range suitable for forging.

10. The method of claim 6 also including the step of bringing said preform and said shaping members to within a temperature range suitable for forging.

11. The method of claim 5 wherein said shaping members are mated dies and said preform is in sheet form.

12. The method of claim 11 wherein said preform has two opposed principal surfaces and the pressure applied to said preform is a fluid pressure loading across said principal surfaces.

* * * * *